US007281904B2

(12) United States Patent
Schultz et al.

(10) Patent No.: US 7,281,904 B2
(45) Date of Patent: Oct. 16, 2007

(54) TRANSMISSION PUMP AND FILTER

(75) Inventors: John C. Schultz, Saline, MI (US); Kent Johnson, Ypsilanti, MI (US); Uk-Jin Song, Wixom, MI (US)

(73) Assignee: General Motors Corporation, Detroit, MI (US)

( * ) Notice: Subject to any disclaimer, the term of this patent is extended or adjusted under 35 U.S.C. 154(b) by 431 days.

(21) Appl. No.: 11/032,551

(22) Filed: Jan. 10, 2005

(65) Prior Publication Data

US 2006/0018767 A1 Jan. 26, 2006

Related U.S. Application Data

(60) Provisional application No. 60/589,275, filed on Jul. 20, 2004.

(51) Int. Cl.

| | |
|---|---|
| ***F04B 23/04*** | (2006.01) |
| *F04B 23/08* | (2006.01) |
| *F04B 23/00* | (2006.01) |
| *F04B 49/00* | (2006.01) |
| *B01D 29/60* | (2006.01) |

(52) U.S. Cl. ..... 417/79; 417/87; 417/307; 417/313; 210/307; 210/440

(58) Field of Classification Search ..... 417/79, 417/87, 313; 210/307, 440
See application file for complete search history.

(56) References Cited

U.S. PATENT DOCUMENTS

| | | | | |
|---|---|---|---|---|
| 2,858,766 | A * | 11/1958 | Toschkoff | 417/79 |
| 3,806,273 | A * | 4/1974 | Clark et al. | 417/79 |
| 3,882,930 | A * | 5/1975 | Schexnayder | 165/278 |
| 4,033,706 | A * | 7/1977 | Schaefer et al. | 417/79 |
| 4,408,961 | A * | 10/1983 | Laybourne | 417/189 |
| 2006/0016740 | A1 * | 1/2006 | Schultz et al. | 210/130 |

* cited by examiner

*Primary Examiner*—Anthony D. Stashick
*Assistant Examiner*—Patrick Hamo

(57) ABSTRACT

The filter housing has a filter outlet portion with a central filter outlet passage. The outlet portion includes a terminal end portion defining a filter nozzle. The filter nozzle forms a nozzle passage between the filter nozzle and the pump housing. The nozzle passage communicates with an annular recess formed in the filter outlet portion. The annular recess receives return bypassed hydraulic fluid from a regulator valve for distribution into an inlet stream of fluid flowing through the filter outlet passage. The inlet stream velocity is increased which increases the pressure at the pump inlet. The increased pressure at the pump inlet allows the pump to operate at higher speeds without cavitation.

11 Claims, 1 Drawing Sheet

TRANSMISSION PUMP AND FILTER

CROSS-REFERENCE TO RELATED APPLICATIONS

This application claims the benefit of U.S. Provisional Application No. 60/589,275, filed Jul. 20, 2004, which is hereby incorporated by reference in its entirety.

BACKGROUND OF THE INVENTION

A fixed displacement pump provides a theoretical fixed amount of oil per each revolution of the pump. Flow-rate is increased in proportion to the rotational speed of the pump. In practice, a limiting pump speed, or high speed fill limit (hereinafter HSFL), is reached when the pump chambers can no longer be completely filled with oil. Incompletely filled pump chambers introduce air into the oil giving rise to a two-phase mixture that potentially causes cavitation. The pump flow-rate levels off to become independent of further increases in the rotational speed of the pump; however, the cavitation phenomena can cause pressure instability that interferes with the transmission control valves and potentially gives rise to objectionable noise. In more severe forms, the collapse of the air bubbles at sonic velocities can cause physical damage to the pump itself.

SUMMARY OF THE INVENTION

It is an object of the present invention to provide an improved transmission filter nozzle adapted to prevent cavitation.

A transmission in accordance with the present invention uses pump oil to activate valves, fill clutches, feed the torque converter, and/or for general lubrication of rotating parts. At higher rotational speeds, the transmission pump output exceeds the transmission requirements such that excess oil is returned, or bypassed, back to the pump inlet. The bypass oil still has pressure energy even as it is being returned to the pump inlet, and such pressure energy is advantageously implemented in the present invention to prevent cavitation. More precisely, the filter nozzle of the present invention converts pump bypass oil pressure energy into fluid momentum at the pump inlet. This increases suction which draws additional oil from the transmission sump through the oil filter. A diffuser shape in the pump raises pressure at the inlet of the rotating group. The increased pressure suppresses two-phase flow, which improves inlet filling to effectively control cavitation noise in the pump. At higher speeds there is more bypass oil, which increases the effectiveness of the annular nozzle.

In a preferred embodiment, the filter nozzle is composed of injection molded plastic and integrally extends from a plastic filter housing. In this manner, multiple components can be simultaneously produced from a single mold thereby saving cost associated with manufacturing and assembly.

The above objects, features and advantages, and other objects, features and advantages of the present invention are readily apparent from the following detailed description of the best mode for carrying out the invention when taken in connection with the accompanying drawings.

DESCRIPTION OF THE PREFERRED EMBODIMENTS

Figure 1:
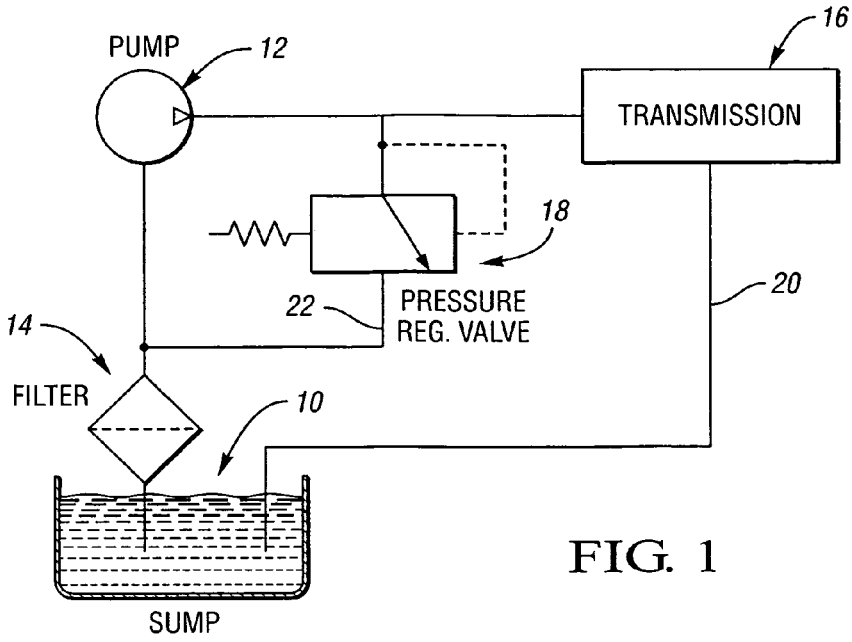
FIG. 1 is a schematic diagram of a portion of a hydraulic system incorporating the present invention.

Referring to the drawings wherein like characters represent the same or corresponding parts through the several views, there is seen in FIG. 1 a schematic representation of a sump or reservoir 10 which contains hydraulic fluid. A transmission control pump 12 draws fluid from the reservoir 10 through a filter assembly 14. The pump 12 delivers pressurized hydraulic fluid to a transmission system 16. The maximum pressure at the pump outlet is determined by a pressure regulator valve 18, which delivers excess pump flow to the filter assembly 14. According to the preferred embodiment of the present invention, the fluid first satisfies the transmission lubrication and pressure requirements, then satisfies the torque converter pressure requirements, then supplies some lube and cooling and finally the excess fluid is returned to the filter assembly 14.

The lube flow and leakage in the transmission system 16 is returned to the reservoir 10 through passages such as 20. The excess flow from the pressure regulator valve 18 is delivered to the filter assembly 14 through a bypass passage 22. The excess fluid leaves the pressure regulator valve 18 with increased velocity and at an elevated pressure, which is higher than the pressure at the reservoir 10.

Figure 2:
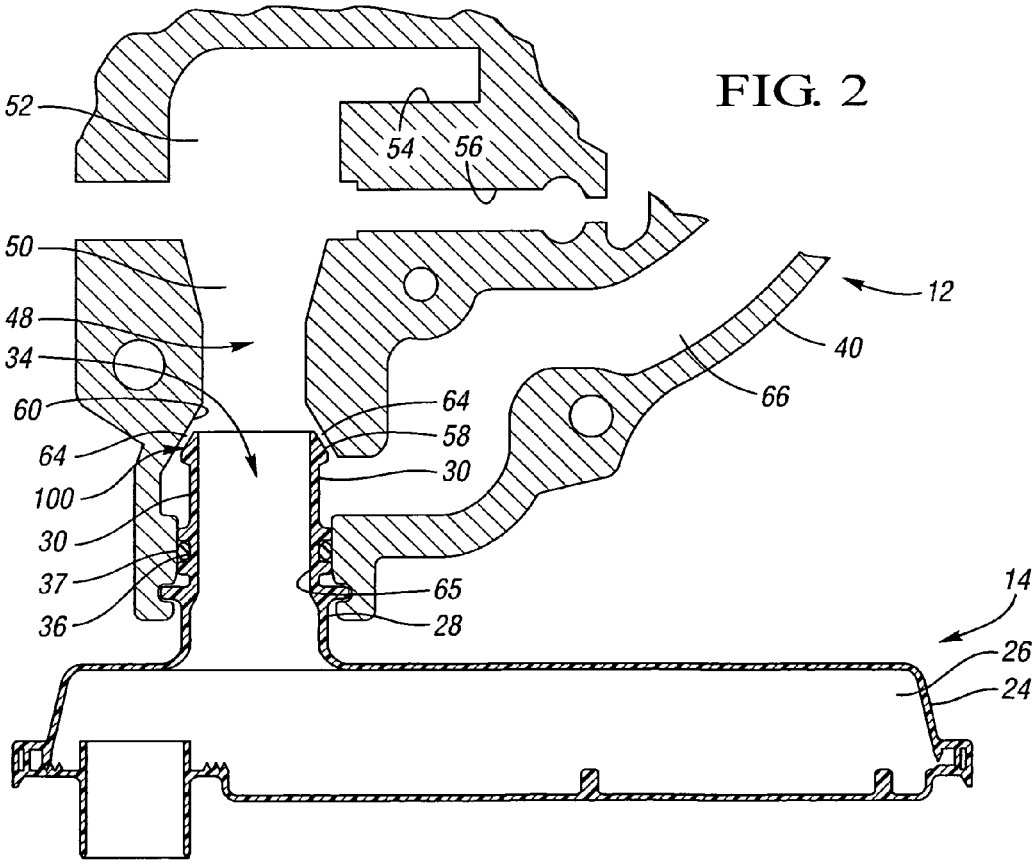
FIG. 2 is a sectional view of a portion of a pump and the filter assembly shown in FIG. 2.

Referring to FIG. 2, the filter assembly 14 includes a housing 24 which has a filter element 26 secured therewith. A filter outlet portion 28 extends substantially perpendicular from the housing 24, and terminates at an opposite end in a filter nozzle 100. All of the hydraulic fluid, which enters from the reservoir 10 (of FIG. 1), passes through the filter element 26. The filter outlet portion 28 has a substantially annular recess 30 formed about an outer wall 65 of a filter outlet passage 34. The filter outlet passage 34 is formed internally of the filter outlet portion 28. All of the fluid passing through the filter element 26 also passes through the passage 34. The filter outlet portion 28 further includes a seal groove 36 formed adjacent the annular recess 30. The seal groove 36 is adapted to accommodate a seal 37.

The filter housing 24 is secured in a pump housing 40. The seal 37 is adapted to seal at least a portion of the interface between the filter housing 24 and the pump housing 40. The filter outlet portion 28 is positioned in a pump inlet bore 48 such that the hydraulic fluid leaving the filter outlet passage 34 enters the pump inlet bore 48. The inlet bore 48 reduces in diameter to form an inlet passage throat 50 downstream of the filter outlet portion 28. The inlet passage throat 50 communicates with a pump inlet plenum 52, which is disposed in fluid communication with inlet ports 54, 56 of the transmission control pump 12. As is well known, the pump 12 is a displacement device which draws fluid in through the inlet ports 54, 56 and delivers pressurized fluid through outlet ports, not shown.

The terminal end of the nozzle 100 is configured to form a nozzle passage 64 between an exterior surface 58 of the nozzle 100 and an interior surface 60 of the inlet passage bore 48. The nozzle passage 64 communicates hydraulic fluid from the annular recess 30 to the inlet bore 48. Fluid enters the annular recess 30 through a fluid return passage 66 in the pump housing 40. As is common with transmission control pumps, the pressure regulator valve 18 (of FIG. 1) is housed in or near the pump housing 40. The passage 66 is directly connected with the bypass passage 22 (of FIG. 1). The hydraulic fluid, which is bypassed at the pressure regulator valve 18, enters the annular recess 30 and is accelerated through the nozzle passage 64 to an increased velocity. This fluid leaves the nozzle passage 64 and enters the fluid stream at the juncture of the filter outlet passage 34 and the pump inlet bore 48.

Due to the high velocity of the fluid leaving the nozzle passage 64, the velocity of the fluid in the passage 34 is increased. As is well known, when the velocity of a fluid increases, the pressure decreases. Thus, the pressure differential across the filter element 26 is increased such that more fluid from the reservoir 10 will be induced to pass through the filter element 26 than would occur without the pressure change caused by the flow through the nozzles passage 64. The fluid velocity is also increased at the inlet passage throat 50, further enhancing the inlet flow to the pump 12.

As the hydraulic fluid enters the pump inlet plenum 52, the velocity decreases and the pressure accordingly increases, thereby creating a supercharge pressure at the pump inlets 54, 56. The increased pressure at the pump inlets 54, 56 increases the cavitation speed of the pump, thereby decreasing the operating noise level at high pump speeds.

In a preferred embodiment, the present invention may be implemented with the twistlock feature disclosed in U.S. Provisional Application No. 60/589,282 entitled "Method and Apparatus for Attaching a Transmission Filter to a Pump", filed Jul. 20, 2004, which is hereby incorporated by reference in its entirety.

While the best mode for carrying out the invention has been described in detail, those familiar with the art to which this invention relates will recognize various alternative designs and embodiments for practicing the invention within the scope of the appended claims.

The invention claimed is:

1. A pump and filter assembly comprising:
- a pump housing having a pump inlet bore and a fluid return passage; and
- a filter assembly including:
  - a filter element; and
  - a filter outlet portion located downstream of said filter element and partially extending into said pump inlet bore in said pump housing, said filter outlet portion further including:
    - a terminal end defining a filter nozzle configured to form a nozzle passage between said filter nozzle and said pump inlet bore;
    - an annular recess formed by said filter outlet portion, said annular recess disposed in fluid communication with said fluid return passage; and
    - a filter outlet passage concentric with and radially inward of said annular recess and being in fluid communication between said filter element, said pump inlet bore, and said nozzle passage to decrease the fluid pressure level at said pump inlet bore to a value less than the pressure level at said filter thereby creating a pressure differential such that cavitation is prevented.

2. The pump and filter assembly of claim 1, wherein said filter assembly further comprises a housing.

3. The pump and filter assembly of claim 2, wherein said filter outlet portion integrally extends from said housing.

4. The pump and filter assembly of claim 3, wherein said housing is composed of injection molded plastic.

5. The pump and filter assembly of claim 1, wherein said filter outlet portion comprises a seal groove disposed about an outer periphery thereof and adjacent said annular recess, said seal groove having a seal disposed therein, said seal being adapted to seal a portion of the interface between said filter outlet portion and said pump inlet bore to maintain said pressure differential.

6. The pump and filter assembly of claim 3, wherein said filter assembly is in fluid communication with a reservoir.

7. A pump and filter assembly comprising:
- a pump comprising a pump housing having a pump inlet bore and a fluid return passage;
- a filter assembly including:
  - a filter element; and
  - a filter outlet portion located downstream of said filter element and partially extending into said pump inlet bore in said pump housing, said filter outlet portion further including:
    - a terminal end defining a filter nozzle configured to form a nozzle passage between said filter nozzle and said pump inlet bore, said nozzle passage being in fluid communication with said pump inlet bore and said fluid return passage;
    - an annular recess disposed in fluid communication with said fluid return passage and said nozzle passage; and
    - a filter outlet passage in fluid communication between said filter element, said pump inlet bore, and said nozzle passage; and
    - a reservoir in fluid communication with said filter assembly;
  - whereby fluid transferred from said return passage through said annular recess and out said nozzle passage decreases the fluid pressure level at said pump inlet bore to a value less than the pressure level at said filter thereby creating a pressure differential such that cavitation is prevented.

8. The pump and filter assembly of claim 7, wherein said filter assembly further comprises a housing.

9. The pump and filter assembly of claim 8, wherein said filter outlet portion integrally extends from said housing.

10. The pump and filter assembly of claim 9, wherein said housing is composed of injection molded plastic.

11. A pump and filter assembly comprising:
- a pump comprising a pump housing having a pump inlet bore and a fluid return passage;
- a filter assembly including:
  - a filter housing;
  - a filter element disposed within said filter housing; and
  - a filter outlet portion integrally extending from a portion of said filter housing, said filter outlet portion located downstream of said filter element and partially extending into said pump inlet bore in said pump housing, said filter outlet portion further including:
    - a terminal end defining a filter nozzle configured to form a nozzle passage between said filter nozzle and said pump inlet bore, said nozzle passage being in fluid communication with said pump inlet bore and said fluid return passage;
    - an annular recess disposed in fluid communication with said fluid return passage and said nozzle passage; and
    - a filter outlet passage in fluid communication between said filter element, said pump inlet bore, and said nozzle passage; and
    - a reservoir in fluid communication with said filter assembly;
  - whereby fluid transferred from said return passage through said annular recess and out said nozzle passage decreases the fluid pressure level at said pump inlet bore to a value less than the pressure level at said filter thereby creating a pressure differential such that cavitation is prevented.

* * * * *